US005686712A

United States Patent [19]

Weber

[11] Patent Number: 5,686,712

[45] Date of Patent: Nov. 11, 1997

[54] ELECTRICAL CONTACT ASSEMBLY

[75] Inventor: William L. Weber, Newburgh, Ind.

[73] Assignee: Siemens Electromechanical Components, Inc., Princeton, Ind.

[21] Appl. No.: 739,489

[22] Filed: Oct. 28, 1996

Related U.S. Application Data

[63] Continuation of Ser. No. 413,295, Mar. 30, 1995, abandoned.

[51] Int. Cl.[6] ..... H01H 33/20

[52] U.S. Cl. ..... 218/31; 218/148

[58] Field of Search ..... 218/15–22, 29–36, 218/40, 146, 148

[56] References Cited

U.S. PATENT DOCUMENTS

| | | | |
|---|---|---|---|
| 1,862,631 | 6/1932 | Penn | 200/147 |
| 2,571,951 | 10/1951 | Schelchlin | 200/147 |
| 2,733,312 | 1/1956 | Christensen | 200/87 |
| 3,064,104 | 11/1962 | Wells et al. | 200/147 |
| 4,006,439 | 2/1977 | Wien et al. | 335/15 |
| 4,028,513 | 6/1977 | Lauback | 200/144 R |
| 4,489,225 | 12/1984 | Masuda et al. | 200/144 R |
| 4,568,805 | 2/1986 | Wycklendt | 200/147 R |
| 4,810,841 | 3/1989 | Wold | 200/147 R |
| 5,109,146 | 4/1992 | Maenishi | 200/147 A |
| 5,495,083 | 2/1996 | Aymami-Pala et al. | 218/1 |

FOREIGN PATENT DOCUMENTS

| | | | |
|---|---|---|---|
| 0341690A2 | 11/1989 | European Pat. Off. | H01H 9/44 |
| 0341690A3 | 11/1989 | European Pat. Off. | H01H 9/44 |
| 1541532 | 11/1968 | France | H01H 9/44 |

*Primary Examiner*—Michael L. Gellner
*Assistant Examiner*—Michael A. Friedhofer
*Attorney, Agent, or Firm*—Joseph S. Codispoti

[57] ABSTRACT

An electrical contact assembly including a pair of first contact arms, each having a terminal end portion, a tip end portion and first contacts fixed to said tip end portions, and a second contact arm arranged opposite the first contact arms and having a tip end portion provided with a lengthened bridge contact. Either the pair of first contact arms or the second contact arm is moveable and the other one is stationary, respectively. Upon actuation of the moveable contact arm or arms, a current path is closed between the first contact arms via said bridge contact. Further, a pair of arc runner strips is provided at opposed lateral edges of either the pair of first contact arms or of the second contact arm. Each of the arc runner strips has a free end projecting toward a facing area of the second contact arm or the first contact arm, respectively. In operation, a pair of opposing magnetic fields is generated between the pair of first contact arms and also, upon contact breaking, between the occurring arcs, causing a repulsive force which moves the arcs towards the arc runner strips so that the arcs can then be extinguished.

14 Claims, 3 Drawing Sheets

ELECTRICAL CONTACT ASSEMBLY

CROSS-REFERENCE TO RELATED APPLICATION

This is a continuation of Ser. No. 08/413,295 filed Mar. 30, 1995, now abandoned.

FIELD OF THE INVENTION

A related application entitled "A Method of Extinguishing an Electric Arc" by the same inventor is being filed on the same date herewith and is incorporated by reference herein.

This invention relates to an electrical contact assembly for switching devices, in particular electromagnetic relays or the like, having stationary and moveable contact elements for switching on and off an AC or DC current.

BACKGROUND OF THE INVENTION

In electromagnetic relays and the like, certain current and voltage conditions cause electric arcs to form between the fixed and moveable contact members when the members are switched off that prevent the breaking of the contact between the contact members. In these cases, an arc extinguishing mechanism has to be provided.

For example, U.S. Pat. No. 5,109,146 describes a switch with contacts which comprises fixed and moveable contact members and an arc extinguishing mechanism. The arc extinguishing mechanism includes a slant member extending obliquely from a front edge portion of the fixed contact member toward a moveable side fixed terminal member. However, this known switch needs an elaborate system of contact members with projecting portions and a terminal member extending beyond the fixed and moveable contacts. Further, this known switch needs an additional separate magnet system for moving the arc towards the arc extinguishing mechanism.

It is thus an object of the present invention to overcome the defects of the existing art.

In particular, it is an object of the present invention to provide a contact assembly for relays and the like which is adapted for breaking high currents by providing an arc extinguishing mechanism which is simple in structure with little expense in parts and compact in overall dimensions.

It is a further object of the present invention to provide a contact assembly with an arc extinguishing mechanism which does not need an additional separate mechanism for moving the arc, like a magnet.

It is still a further object of the present invention to provide a contact assembly with an arc extinguishing mechanism in which the magnetic field generated by the load current itself is utilized for moving the arc.

SUMMARY OF THE INVENTION

The above and other objects are obtained by the present invention which provides a contact assembly, comprising:

- a pair of first contact arms arranged side by side in a common plane, each having a terminal end portion and a tip end portion;
- a pair of first contacts, each disposed at the tip end portion of a respective first contact arm;
- a second contact arm arranged opposite said pair of first contact arms in a second plane, said second contact arm having a tip end portion;
- a lengthened bridge contact disposed at the tip end portion of said second contact arm and facing both of said first contacts, wherein one of said pair of first contact arms and said second contact arm is moveable and the other one is stationary and upon actuation of said moveable member a current path is closed between said first contacts via said bridge contact; and
- a pair of arc runner strips, each extending from opposed lateral edges near the tip end portions of one of said pair of first contact arms and said second contact arm and each having a free end projecting toward a facing area of the other one of said second contact arm and said first contact arms.

In a preferred embodiment, the first contact arms are stationary and the second contact arm is moveable and the arc runner strips are formed integral with the second contact arm.

BRIEF DESCRIPTION OF THE DRAWINGS

For a better understanding of the invention, reference is made to the following description of an exemplary embodiment thereof, and to the accompanying drawings, wherein:

FIG. 1 is a plane view of a contact assembly constructed in accordance with the present invention, which may be included in an electromagnetic relay or the like;

DETAILED DESCRIPTION

Figure 1:
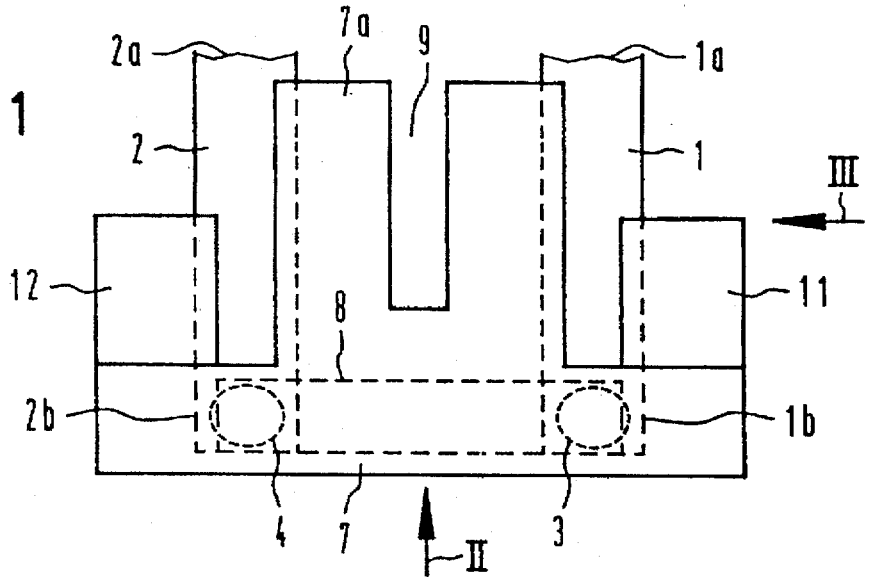
Figure 2:
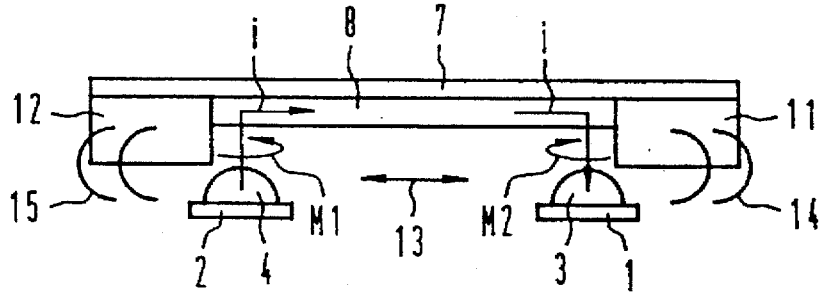
FIG. 2 is a front view of the contact assembly of FIG. 1 taken from the direction of arrow II.
Figure 3:
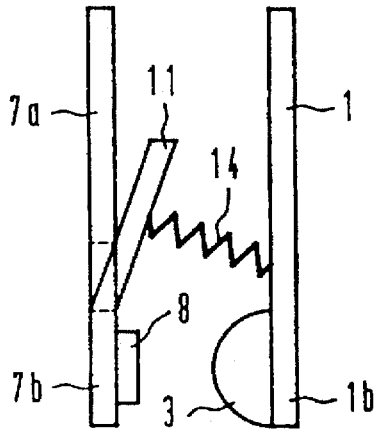
FIG. 3 is a side view of the contact assembly of FIG. 1 taken from the direction of arrow III.

Referring to the drawings, and initially to FIGS. 1 to 3, a contact assembly constructed in accordance with the present invention includes a pair of stationary contact arms 1 and 2, which are arranged parallel to one another in a common plane and may be fixed in a suitable manner. The contact arms 1 and 2 have respective terminal ends 1*a* and 2*a* enclosed in an insulating contact carrier or relay housing (see, for example, FIG. 6).

Figure 4:
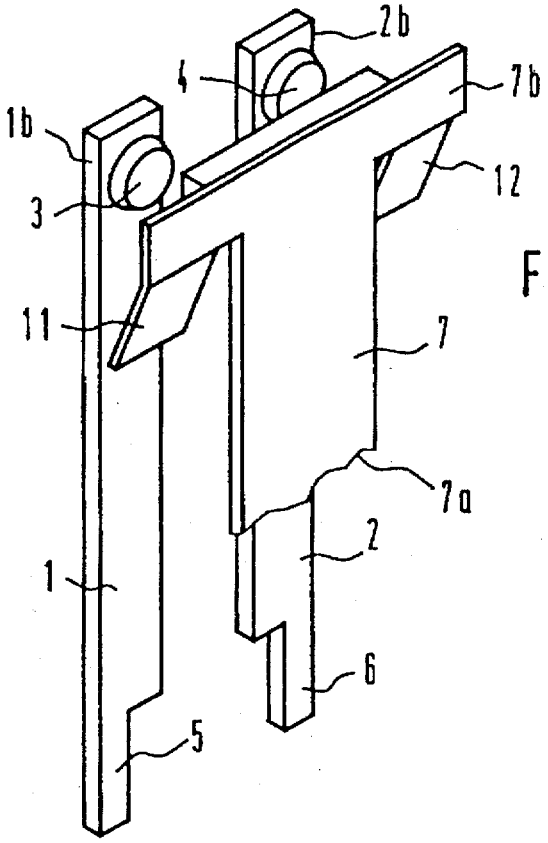
FIG. 4 is a perspective view of a second contact assembly constructed in accordance with the present invention.
Figure 6:
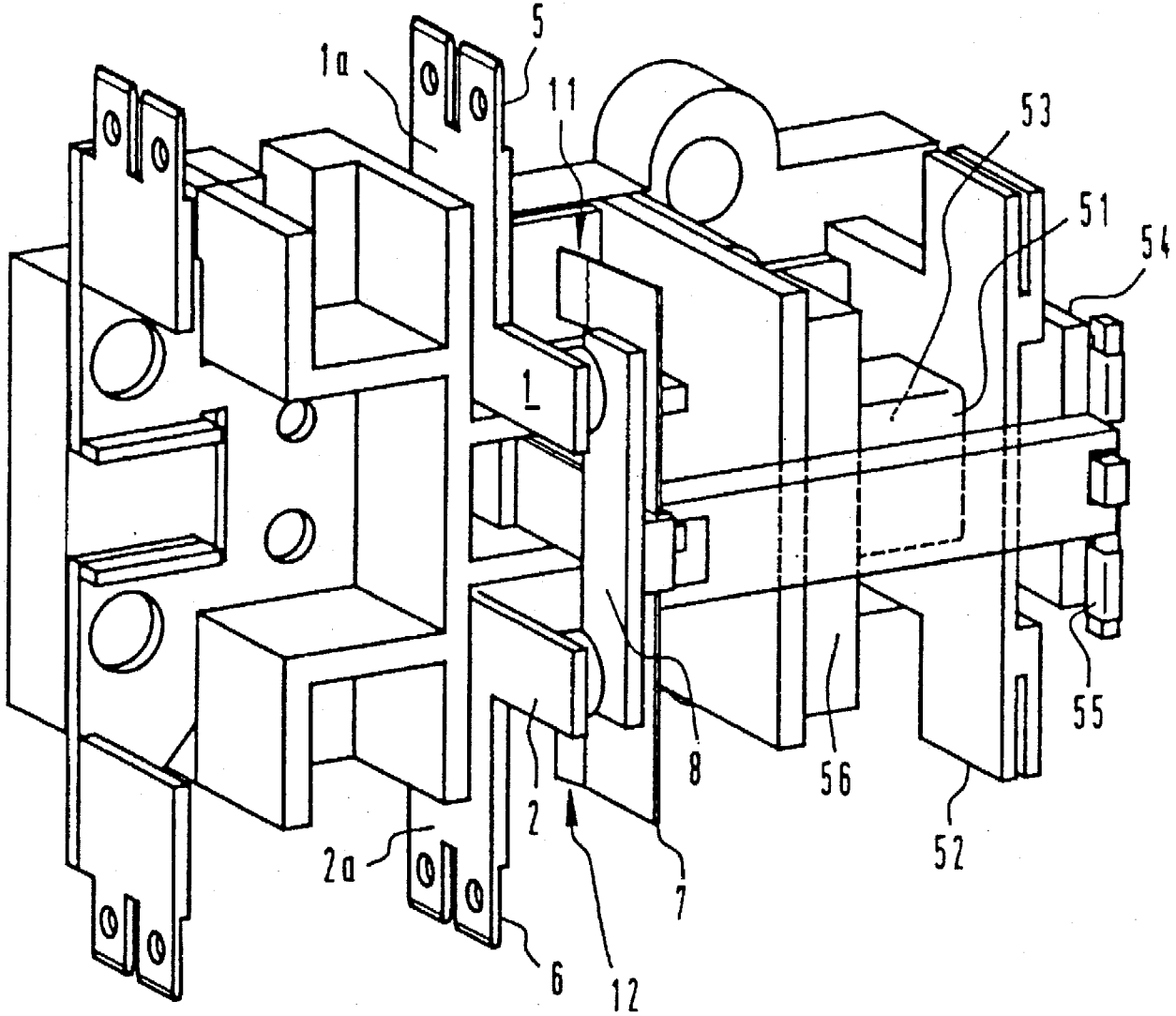
FIG.6 is a perspective view of a relay, without a housing cover, that contains another modification of the contact assembly shown in FIG. 4.

Further, the contact arms 1 and 2 have respective free or tip ends 1*b* and 2*b*, each with a respective stationary contact 3 and 4 fixed thereon. The stationary contact arms 1 and 2 may be made from a sheet material having high conductivity like copper or copper alloy. The terminal ends 1*a* and 2*a* are provided with terminals 5 and 6, for example, as shown in FIGS. 4 and 6, through which the contact arms 1 and 2 may be connected to an electrical circuit including a current source (not shown).

Further, the contact assembly includes a moveable contact arm 7 which is generally T-shaped with a longitudinal main beam 7*a* and a cross beam or tip end 7*b*. A lengthened bridge contact 8 is fixed on the tip end 7*b*. The moveable contact arm 7 is arranged in a plane parallel to the plane of the stationary contact arms 1 and 2 so as to keep the bridge contact 8 in a position facing both of the stationary contacts 3 and 4. The moveable contact arm 7 may be made from a resilient plate material, preferably from stainless steel or the like. Since the moveable contact arm 7 does not need a terminal, the end of the main beam 7*a* can be fixed in the insulating contact carrier or relay housing (see, for example, FIG. 6). The moveable contact arm 7 can be actuated by a pusher or it can be fixed directly to an armature in the relay. The main beam 7*a* can be divided by a recess 9 into two legs, as shown in FIG. 1, or it can have a single leg as shown in FIGS. 4 and 6.

A pair of arc runner strips 11 and 12 are provided on both lateral sides of the moveable contact arm 7, extending from the cross beam 7*b* along the main beam 7*a* and being bent in an acute angle toward the stationary contact arms 1 and 2. The arrangement and the dimension of the stationary contact arms 1 and 2 and of the moveable contact arm 7 are made in such a way that the arc runner strips 11 and 12 face or overlap at least the surface of the opposing stationary contact arm 1 or 2, respectively. The function of the contact assemblies shown in FIGS. 1 to 3, 4 and 6 is next to be described.

Referring to FIG. 2, the contacts are shown in an open condition. When the contacts are closed, a current i will flow from the stationary contact arm 2 through the stationary contact 4, the bridge contact 8, the other stationary contact 3 to the stationary contact arm 1. This current i will generate in the contact arm 2 and the stationary contact 4 a magnetic field M1 with a first field direction, while the same current i flowing in the stationary contact arm 1 in the reverse direction will generate in this contact arm 1 and the stationary contact 3 a magnetic field M2 with a field direction which is opposite to that of the magnetic field M1. As a result, the opposing magnetic fields M1 and M2 cause a repulsive magnetic force between the stationary contacts 3 and 4, designated with a double arrow 13.

When the contacts are opened and arcs 14 and 15 are generated (see FIGS. 2 and 3), the magnetic fields M1 and M2 are still effective, and the resulting repulsive force 13 moves the arcs 14 and 15 away from each other towards the arc runner strips 11 and 12. The arc runner strips 11 and 12 provide additional material and area for the arcs to continue until the conditions are such that the arcs can no longer sustain themselves. Thus, no additional magnetic means are necessary in a contact assembly of the present invention for moving an arc towards the respective arc runner strip and extinguishing the arc.

Figure 5:
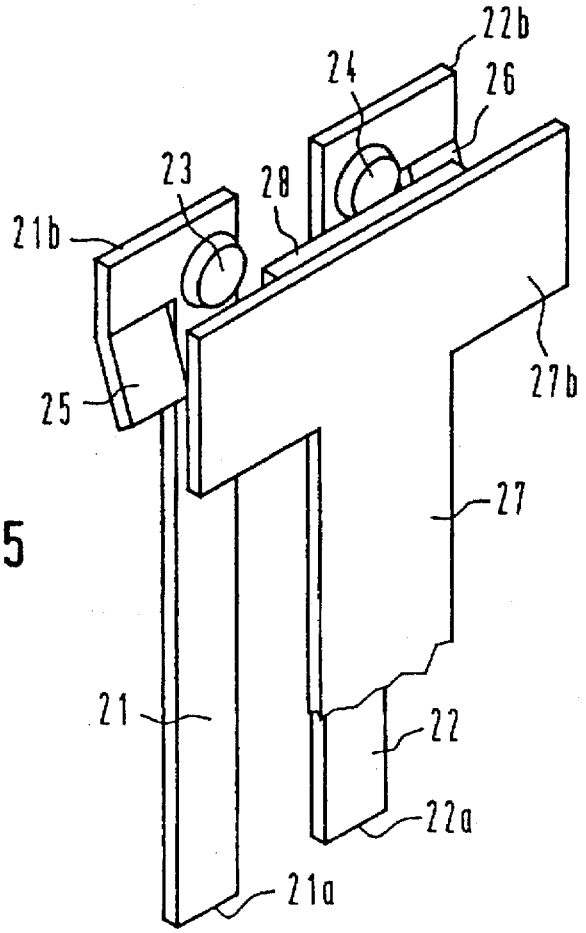
FIG.5 is a perspective view showing a modification of the contact assembly shown in FIG. 4.

FIG. 5 shows a modification of the contact assembly of FIG. 4. The figure shows a pair of stationary contact arms 21 and 22 having respective terminal ends 21*a* and 22*a* and respective tip ends 2l*b* and 22*b* provided with stationary contacts 23 and 24. Further, two arc runner strips 25 and 26 are provided extending from the tip ends 21*b* and 22*b*, respectively, of the stationary contact arms 21 and 22. Similar to the contact assembly of FIG. 4, a moveable contact arm 27 is provided having an enlarged tip end 27*b* and a bridge contact 28 fixed thereto. The arc runner strips 25 and 26 are bent towards the enlarged tip end 27*b* of the moveable contact arm 27 so as to face at least a section thereof. The functioning of the modified contact assembly is the same as described above.

FIG. 6 shows a relay, without a housing cover, that contains another modification of the contact assembly of FIG. 4. The relay includes an energizing coil 51 wound around a bobbin 52 that contains a magnetic core 53 therethrough. The relay also includes an armature 54 that is connected at one end to the bobbin 52 or a frame 55 and at the other end to a pusher 56. The pusher 56 couples the armature 54 to the moveable contact arm 7 of the contact assembly. As illustrated, the contact assembly may have the terminal ends 1*a* and 2*a* of the stationary contact arms 1 and 2 configured so as to accommodate the assembly of the relay. The figure specifically shows the terminal ends 1*a* and 2*a* extending laterally from the stationary contact arms 1 and 2, respectively. The functioning of the modified contact assembly is the same as described above. It is noted that any of the described contact assemblies may be similarly modified.

Other modifications are possible within the scope of the invention. For example, the first contact arms bearing single contacts can be moveable while the opposing contact arm bearing a bridge contact can be made stationary. Also, the arc runner strips can be provided either at the moveable or the stationary contact arms. It is essential only that, independent of the specific design of contact arms and actuating mechanism, a pair of opposing current paths are provided causing repulsive magnetic fields for the arcs which may occur at contact breaking.

Also, the arc runners can be formed of any configuration or material to facilitate the movement of an arc from the contacts onto the arc runners and the extinguishing of the arc. Preferably, the arc runners are made of stainless steel and extend obliquely from the respective contact arm.

What is claimed is:

1. An electrical contact assembly for a switching device comprising:

a pair of first contact arms arranged in a common plane, each having a terminal end portion and a tip end portion;

a pair of first contacts, each disposed at the tip end portion of a respective first contact arm;

a second contact arm arranged opposite said pair of first contact arms in a second plane, said second contact arm having a tip end portion;

a bridge contact disposed at the tip end portion of said second contact arm and facing both of said first contacts, wherein one of said pair of first contact arms and said second contact arm is moveable and the other one is stationary and upon actuation of said moveable member a current path is closed between said first contact arms via said bridge contact; and a pair of arc runner strips, each extending from opposed lateral edges at the tip end portion of one of each first contact arm and said second contact arm and each having a free end projecting toward a facing area of the other one of said second contact arm and said first contact arms.

2. The contact assembly of claim 1, wherein said first contact arms are stationary and said second contact arm is moveable.

3. The contact assembly of claim 2, wherein said arc runner strips are formed integral with said second contact arm.

4. The contact assembly of claim 3, wherein said second contact arm has generally a T-shape with a main beam and a crossbeam, said bridge contact being provided on said crossbeam in a longitudinal direction thereof and said arc runner strips extending from both ends of the crossbeam parallel to said main beam.

5. The contact assembly of claim 4, wherein said second contact arm is made from a resilient plate material and said first contact arms are made from a material having high electrical conductivity.

6. The contact assembly of claim 4, wherein said second contact arm is a stainless steel spring blade.

7. The contact assembly of claim 1, wherein said arc runner strips are stainless steel.

8. The contact assembly of claim 1, wherein said arc runner strips extend obliquely from said lateral edges.

9. An electrical contact assembly comprising:

a pair of stationary contact arms arranged in a common plane, each having a terminal end portion and a tip end portion;

a pair of stationary contacts, each disposed at the tip end portions of a respective stationary contact arm;

a moveable contact arm arranged opposite said stationary contact arms in a second plane, said moveable contact arm having a tip end portion;

a moveable bridge contact disposed at the tip end portion of said moveable contact arm and facing both of said stationary contacts, wherein upon actuation of said moveable contact arm a current path is closed between said stationary contact arms via said bridge contact; and a pair of arc runner strips, each extending from opposed lateral edges at the tip end portion of said moveable contact arm and each having a free end projecting toward a facing area of the respective opposing stationary contact arm.

10. The contact assembly of claim 9, wherein said arc runner strips are formed integral with said moveable contact arm.

11. The contact assembly of claim 10, wherein said moveable contact arm is a stainless steel spring blade.

12. The contact assembly of claim 9, wherein said arc runner strips are stainless steel.

13. The contact assembly of claim 9, wherein said arc runner strips extend obliquely from said lateral edges.

14. An electromagnetic switch, comprising:

a coil assembly having a magnetic core, a coil wound around the core, and a frame that holds the coil and core;

a contact assembly having a) a pair of first contact arms arranged in a common plane, each having a terminal end portion and a tip end portion;

b) a pair of first contacts, each disposed at the tip end portion of a respective first contact arm;

c) a second contact arm arranged opposite said pair of first contact arms in a second plane, said second contact arm having a tip end portion;

d) a bridge contact disposed at the tip end portion of said second contact arm and facing both of said first contacts, wherein one of said pair of first contact arms and said second contact arm is moveable and the other one is stationary and upon actuation of said moveable member a current path is closed between said first contact arms via said bridge contact; and e) a pair of arc runners, each extending from opposed lateral edges at the tip end portion of one of each first contact arm and said second contact arm and each having a free end projecting toward a facing area of the other one of said second contact arm and said first contact arms, respectively; and means for actuating the moveable contact member upon energization and de-energization of the coil.

* * * * *